US007293667B2

(12) United States Patent
Flynn

(10) Patent No.: US 7,293,667 B2
(45) Date of Patent: Nov. 13, 2007

(54) HEIGHT ADJUSTABLE SHELF CLAMP

(75) Inventor: Mark Flynn, Warlingham (GB)

(73) Assignee: Home Decor Holding Company, Charlotte, NC (US)

( * ) Notice: Subject to any disclaimer, the term of this patent is extended or adjusted under 35 U.S.C. 154(b) by 340 days.

(21) Appl. No.: 11/105,121

(22) Filed: Apr. 13, 2005

(65) Prior Publication Data

US 2005/0205509 A1 Sep. 22, 2005

Related U.S. Application Data

(63) Continuation-in-part of application No. 10/076,082, filed on Feb. 15, 2002, now abandoned.

(51) Int. Cl.
*A47B 43/00* (2006.01)

(52) U.S. Cl. ..... 211/189; 211/192; 211/187; 248/245

(58) Field of Classification Search ..... 211/102, 211/189, 187, 190, 207, 103, 191, 192; 248/250, 248/243–246; 108/97, 98, 152
See application file for complete search history.

(56) References Cited

U.S. PATENT DOCUMENTS 1,041,264 A * 10/1912 Freud ..... 248/245
2,729,314 A 1/1956 Doran
3,018,900 A 1/1962 Huet
3,081,972 A 3/1963 Gray, Jr.
3,132,609 A * 5/1964 Chesley ..... 108/106
3,143,981 A 8/1964 Tassell
3,151,576 A 10/1964 Patterson
3,178,775 A 4/1965 Tassell
3,228,646 A 1/1966 Hinrichs et al.
3,250,584 A 5/1966 Tassell
3,771,466 A 11/1973 Ferdinand et al.
3,828,937 A 8/1974 Nash
3,865,338 A * 2/1975 Campbell ..... 248/297.21
4,056,196 A 11/1977 Brauning
4,231,300 A * 11/1980 Shepard ..... 108/192
4,519,511 A 5/1985 Mendenhall
4,653,652 A * 3/1987 Avati ..... 211/189
4,895,331 A * 1/1990 Nehls ..... 248/245
4,919,282 A 4/1990 Duff et al.
5,036,778 A 8/1991 Briosi
5,148,928 A 9/1992 Arnold
5,154,385 A 10/1992 Lindberg et al.

(Continued)

FOREIGN PATENT DOCUMENTS

DE 3934060 C1 1/1991

(Continued)

*Primary Examiner*—Jennifer E. Novosad

(57) ABSTRACT

A modular shelf assembly has a vertical support having a channel in one face thereof and an adjustable bracket having a rear portion cooperatively configured and slidable in the channel. The bracket includes top and lower clamps each having a body portion with opposed clamping surfaces and depending leg portions. The leg portions are slidable relative to each other, and an adjusting screw is engaged with the upper clamp to effect relative movement between the clamping surfaces to clamp a shelf between the clamping surfaces. The bracket also has a positioning fastener seated in the lower clamp below the shelf and extending through the clamps to engage the support to secure the clamps to each other and to the support.

6 Claims, 6 Drawing Sheets

U.S. PATENT DOCUMENTS

| | | | | |
|---|---|---|---|---|
| 5,170,898 | A * | 12/1992 | Katz et al. | 211/193 |
| 5,348,385 | A | 9/1994 | Berg | |
| 5,354,025 | A * | 10/1994 | McCaffrey | 248/188 |
| 5,605,238 | A | 2/1997 | Jacobs | |
| 5,615,854 | A * | 4/1997 | Nomura et al. | 248/287.1 |
| 5,645,177 | A * | 7/1997 | Lin | 211/70.6 |
| 5,813,641 | A | 9/1998 | Baldwin | |
| 5,950,974 | A * | 9/1999 | Hoffmann | 248/223.41 |
| 6,105,794 | A * | 8/2000 | Bauer | 211/94.01 |
| 6,123,033 | A | 9/2000 | Polley et al. | |
| 6,382,436 | B1 * | 5/2002 | Wang | 211/207 |
| 6,425,563 | B1 * | 7/2002 | Mihailoff | 248/245 |
| 6,776,466 | B2 * | 8/2004 | Harvie, III | 312/351 |
| 6,827,320 | B2 * | 12/2004 | Yeh | 248/220.22 |
| 2006/0032830 | A1 * | 2/2006 | Engel | 211/187 |

FOREIGN PATENT DOCUMENTS

| | | |
|---|---|---|
| DE | 200 00 627 U1 | 6/2001 |
| EP | 1 336 360 A2 | 8/2003 |
| FR | 79 29717 | 11/1979 |
| GB | 1 468 433 | 3/1977 |

* cited by examiner

HEIGHT ADJUSTABLE SHELF CLAMP

CROSS REFERENCE TO RELATED APPLICATION

The present application is a continuation-in-part of U.S. Application for Letters patent application Ser. No. 10/076,082 filed Feb. 15, 2002 now abandoned.

BACKGROUND OF THE INVENTION

The present invention relates to a modular storage structure which includes shelves and the like supported on vertical supports. More particularly, the present invention relates to a novel bracket for adjustably supporting shelves on the vertical supports.

In application Ser. No. 10/076,082 filed Feb. 15, 2002, there is described a novel modular storage system which has vertical supports on which are mounted various types of storage components. Among the components of that system are brackets which can be adjustably mounted in channels of the supports. The brackets can be readily adjusted on the vertical supports. However, as is frequently the case, a shelf which is supported in a horizontal position between a pair of supports is found not to be level and one of the brackets must be moved vertically on the vertical support. In order to do so, this may require removal of the shelf to be able to manipulate the bracket components and reposition the bracket.

It is an object of the present invention to provide a novel mounting bracket for a modular storage system that can be easily adjusted after a shelf or the like has been mounted therein.

SUMMARY OF THE INVENTION

It has now been found that the foregoing and related objects may be readily attained in a modular shelf assembly which includes a vertical support having a channel in one face thereof, an adjustable bracket having a rear portion cooperatively configured and slidable in the channel. The bracket includes a lower clamp having a body portion with a clamping surface at its upper end and a depending leg portion, and a top clamp having a body portion and a clamping surface at its lower end cooperating with the clamping surface of the lower clamp and a depending leg portion. The leg portions are slidable relative to each other. An adjusting screw on the lower clamp is engaged with the upper clamp to effect relative movement between the clamping surfaces to clamp a shelf between the clamping surfaces and a shelf having an end clamped in the bracket. The bracket also has a positioning fastener seated in the lower clamp below the shelf and extending through the clamps to engage the support to secure the clamps to each other and to the support.

Preferably, the vertical support is configured to provide a bracket receiving channel in opposite faces thereof and most desirably, the vertical support has four faces with panel receiving channels in the other faces thereof.

The bracket receiving channel(s) has a keyway at the inner end thereof which seats a locking washer cooperating with the positioning fastener. The upper clamp has a recess which seats a locking washer cooperating with the adjusting screw. The lower clamp has a channel in which is slidable the depending leg portion of the upper clamp.

BRIEF DESCRIPTION OF THE DRAWINGS

FIG. 1 is a perspective view illustrating a storage system using the novel adjustable brackets of the present invention for supporting shelves and the like;

DETAILED DESCRIPTION OF THE PREFERRED EMBODIMENTS

The present application is a continuation-in-part application Ser. No. 10/076,082 filed Feb. 15, 2002 and is directed to an improvement on the adjustable bracket therein. Applicant incorporates by reference the specification and drawings of the patent application.

In the aforementioned patent application, the adjustable bracket has the positioning fastener 114 seated in the upper clamping member as shown in FIG. 15 thereof. As a result, a shelf seated in the bracket blocked access to the positioning fastener 114 so that the bracket could not be adjusted along the vertical support.

Figure 1:
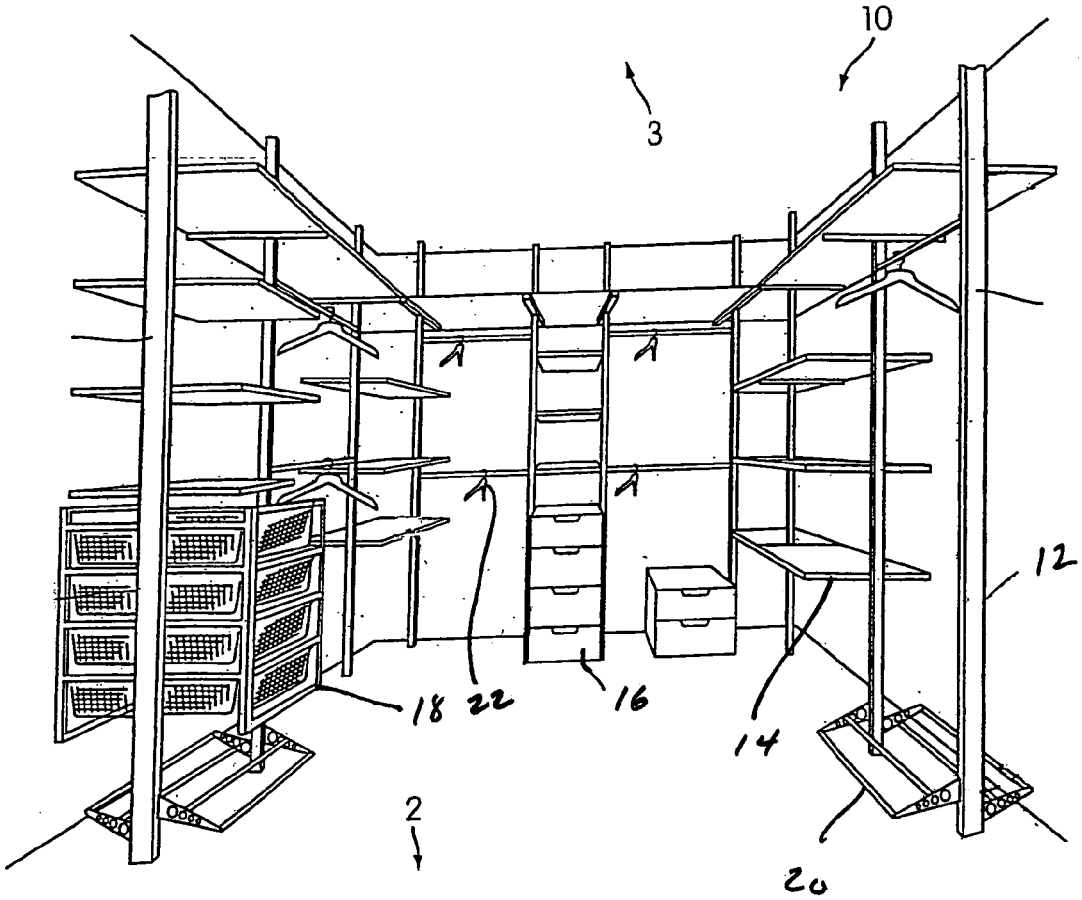

FIG. 1 illustrates an enclosure with a floor 2 and a ceiling 3 and in which is installed a storage system generally designated by the numeral 10. The storage system 10 includes elongated vertical supports or stanchions 12 and one or more storage components including shelves 14, drawers 16, baskets 18, shoe racks 20 and adjustable brackets 22. It is contemplated that any combination of vertical supports 12 may be used so that the storage system 10 may extend along one or more walls in a room, or rows of storage may be created by mounting rows of vertical supports 12 in the center of a room.

Figure 2:
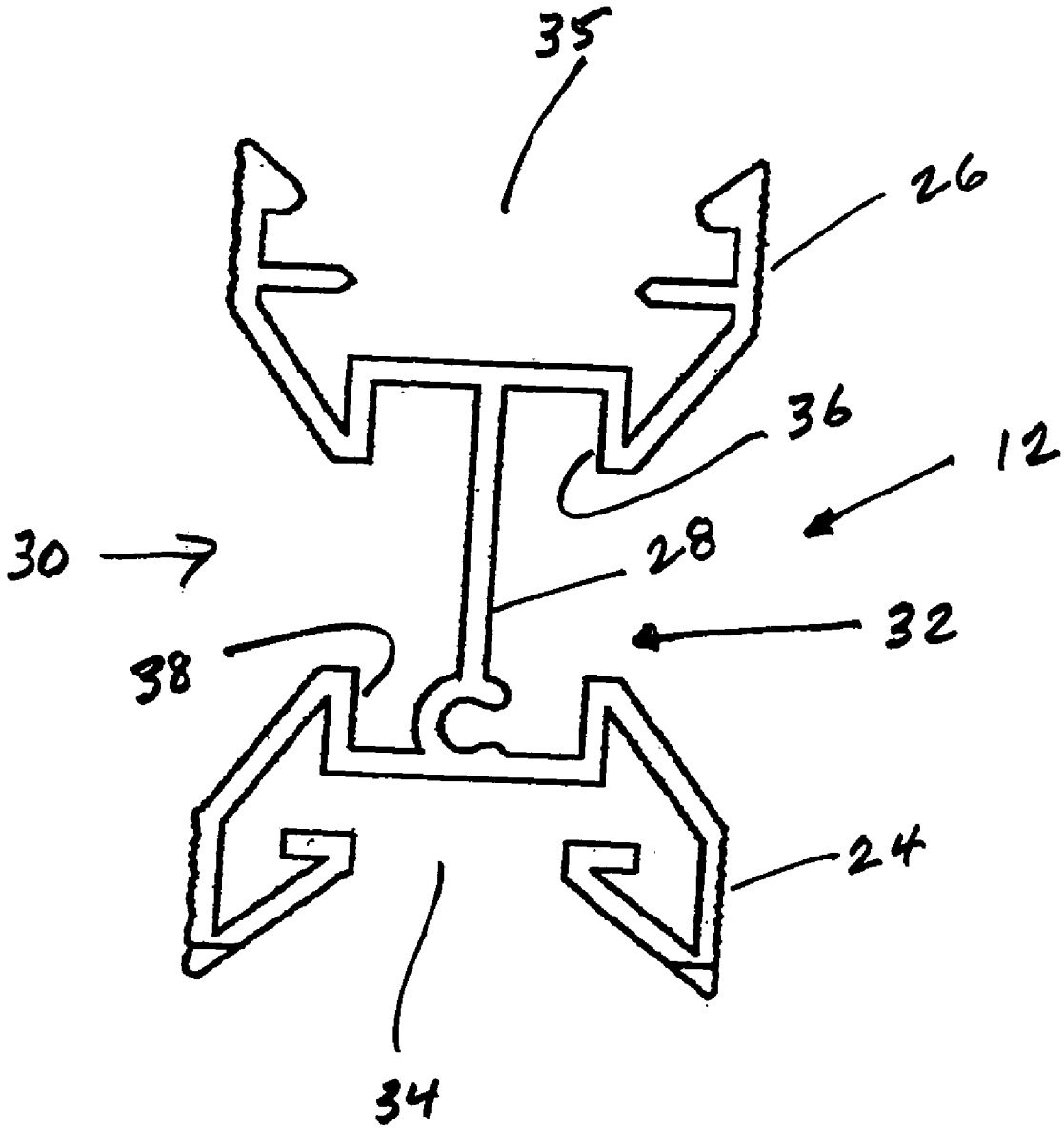
FIG. 2 is a cross-sectional view of the vertical supports shown in FIG. 1.

The elongated vertical support 12 of FIG. 1 is shown in greater detail in FIG. 2. Each elongated vertical support 12 includes a front portion 24, a rear portion 26, and a center portion 28 which cooperate to provide channels 30, 32, on opposite side surfaces and the front and rear portions 26 also have channels 34, 35 therein. The several portions cooperate to provide a keyway 36 or 38 at the inner end of the channel 30, 32. The elongated vertical support 12 can be formed by extrusion of metal or reinforced resin, or by roll forming metal strip. As illustrated in FIG. 1, the vertical support 12 is of a length to extend from the floor 2 to the ceiling 3.

Figure 3:
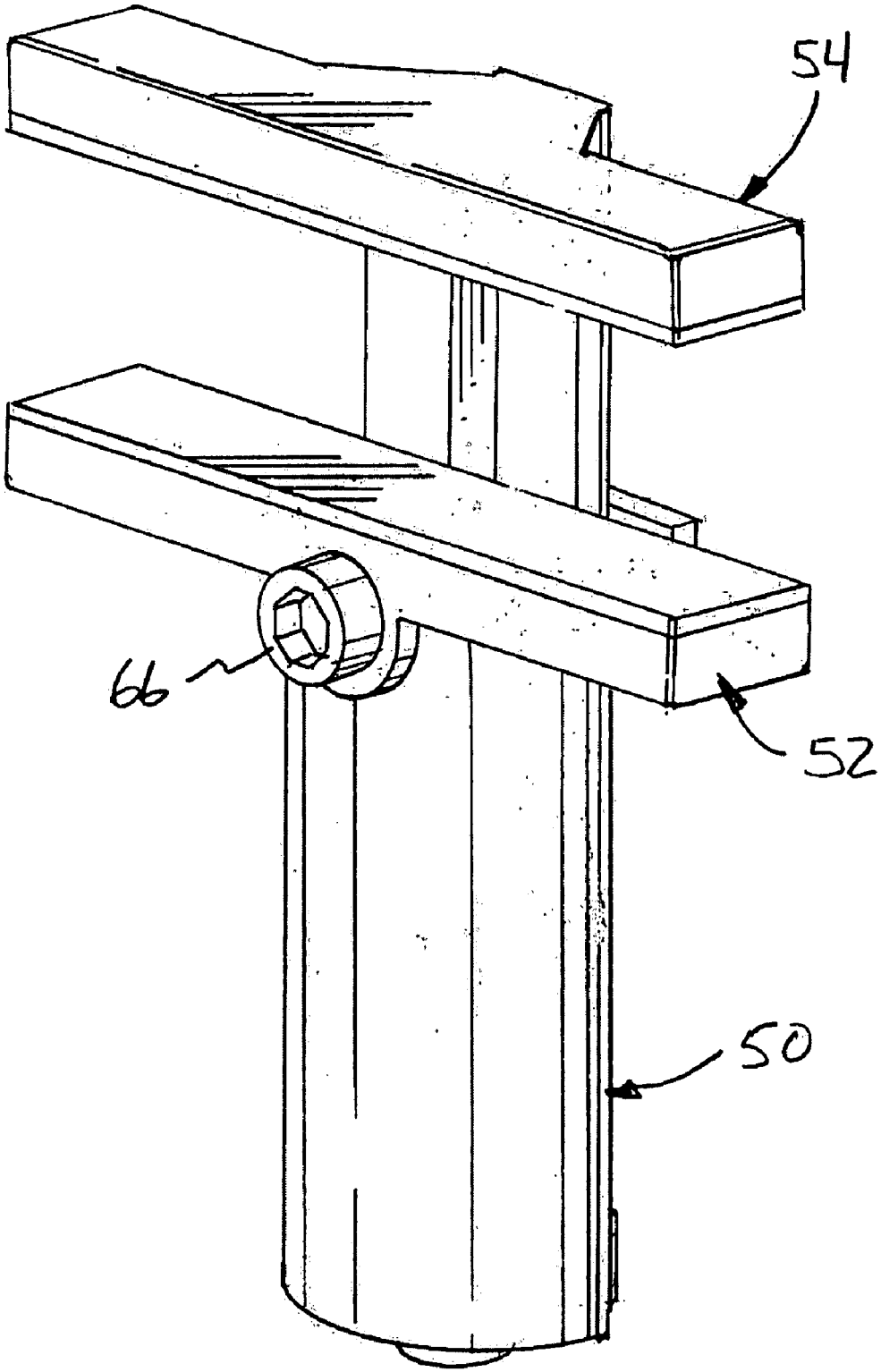
FIG. 3 is a perspective view of an adjustable bracket of the present invention mounted upon a fragmentarily illustrated vertical support.
Figure 4:
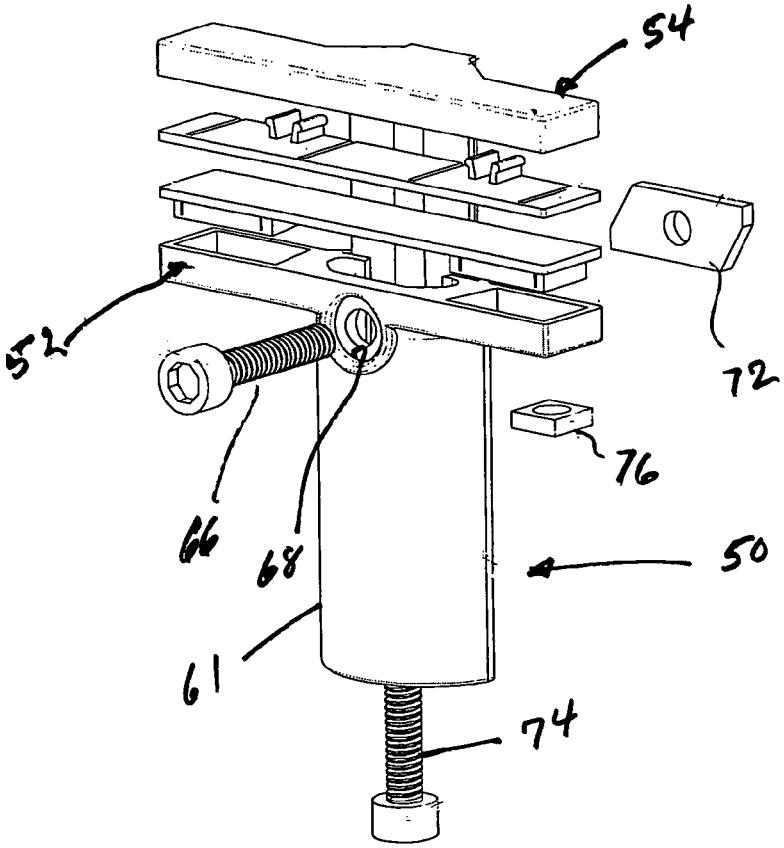
FIG. 4 is an exploded front perspective view of the bracket.
Figure 5:
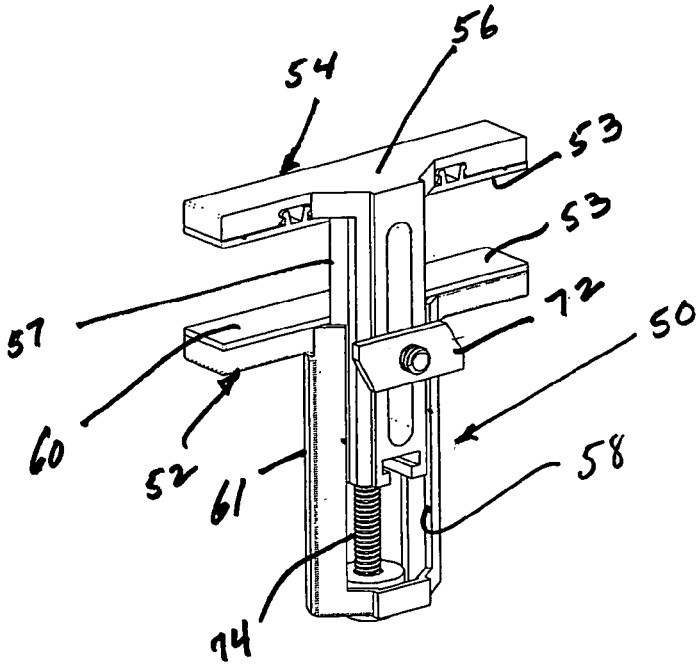
FIG. 5 is a rear perspective view of the bracket.
Figure 6:
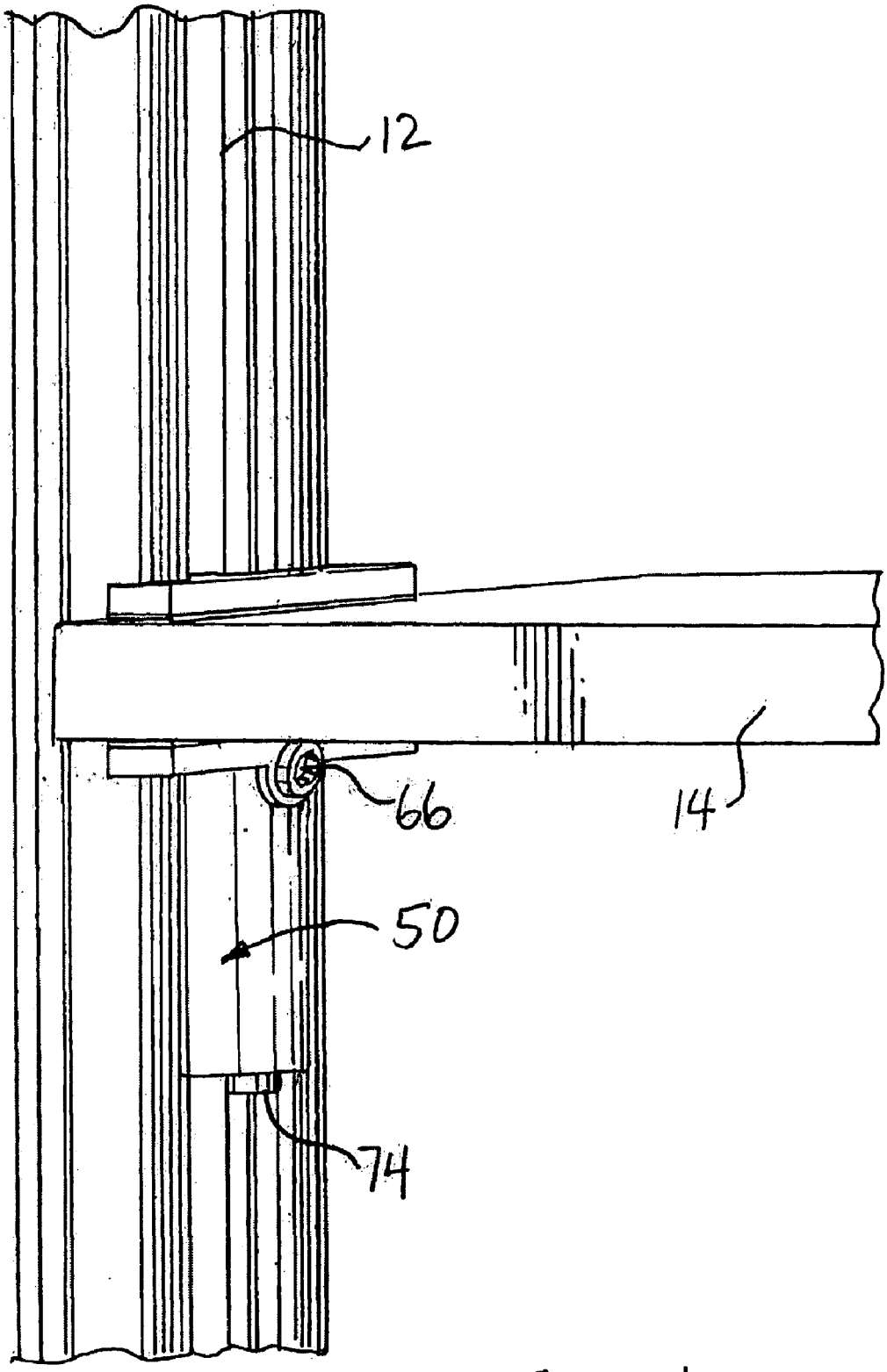
FIG. 6 is a view similar to FIG. 3 with a fragmentarily illustrated shelf clamped therein.
Figure 7:
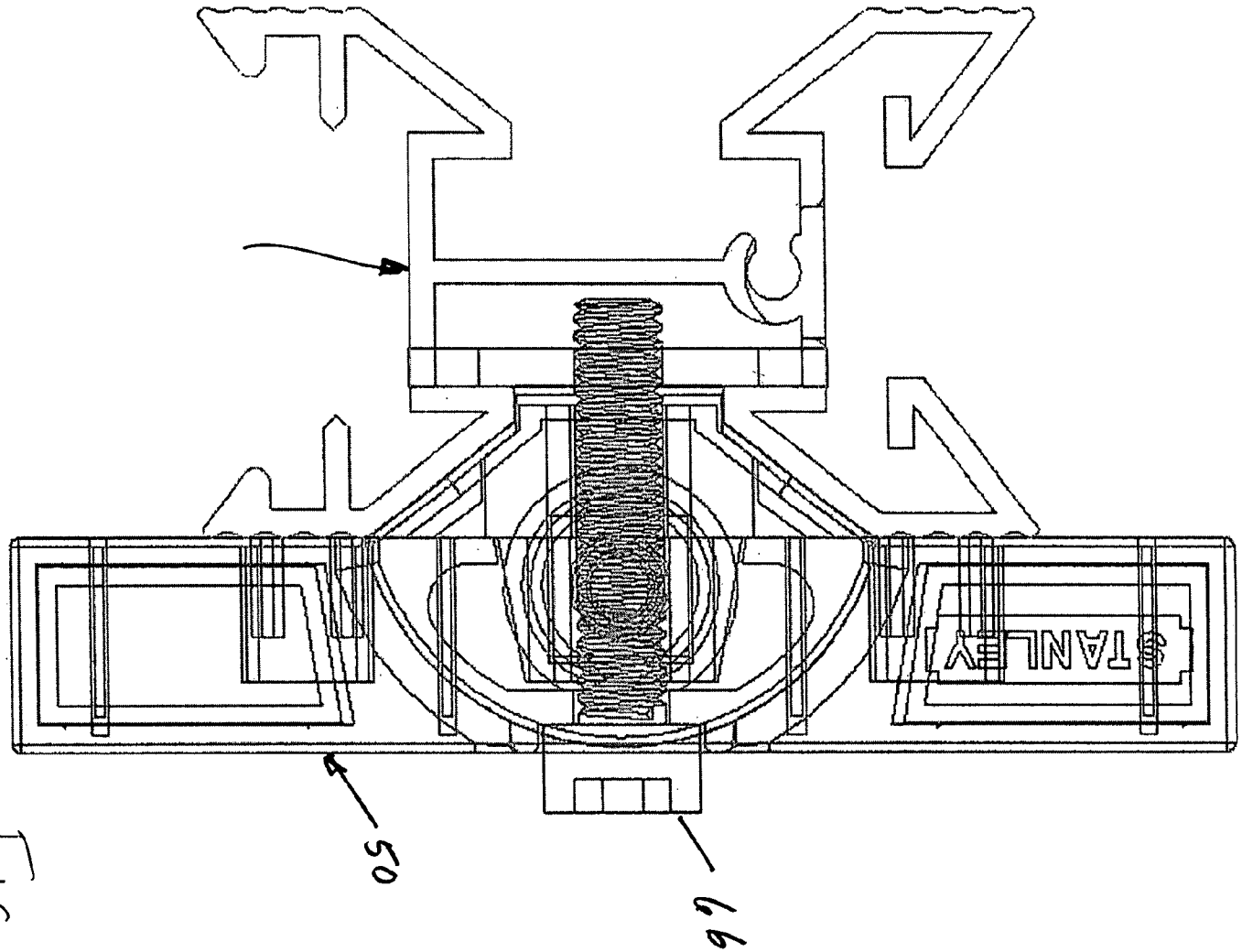
FIG. 7 is a cross sectional view of the bracket and vertical support.

As seen in FIG. 3, the shelves 14 are supported in adjustable brackets generally designated by the numeral 50. The bracket 50 has a lower clamp generally designated by the numeral 52 and an upper clamp generally designated by the numeral 54 with which opposed clamping surfaces 53 which are movable relative to each other. The upper clamp 54 has a body portion 56 and a depending leg portion 57 and the lower clamp 52 has a body portion 60 and a depending leg portion 61. The depending leg portion 57 is slidably seated in a channel 58 in the depending leg portion 61 of the lower clamp 52.

The clamps 52, 54 are configured to provide a rear surface which is complementary to the channel 30, 32 in the support 12 so as to be slidable therein.

The upper and lower clamps 52, 54 are secured to each other, and the bracket 50 is secured to the support 12, by the threaded fastener 66 which seats in apertures 68 in the depending leg portions 57, 61 and is threadably engaged in the locking washer 72 which is seated in the keyway 36 of the support 12.

The upper clamp 54 may be drawn towards the lower clamp 52 by the elongated adjusting screw 74 which is seated in the leg portion 61 of the lower clamp 60 and has its upper end engaged in a washer 76 trapped in the depending leg portion 57 of the upper clamp 56. Rotation of the screw 74 causes the clamps 52, 54 to move relative to each other to effect firm engagement of a shelf 14 therebetween.

The fastener 66 is exposed on the front face of the lower clamp 52 below the shelf 14. By loosening the fastener 66, the bracket 50 may be moved upwardly or downwardly in the support channel 32 to the desired position.

The clamps 52, 54 are conveniently die cast from metal or molded from synthetic resin so as to provide a major portion and the clamping surface.

As will be appreciated, vertical panels (not shown) may be seated in the channels 38, 40. Other modular components may also be included as illustrated and described in the aforementioned patent application.

Thus, it can be seen that the bracket of the present invention provides easy access to the positioning fastener even with a shelf mounted therein so that it may be readily adjusted on the vertical support.

Having thus described the invention, what is claimed is:

1. In a modular shelf assembly, the combination of (a) a vertical support having a channel in one face thereof;

(b) an adjustable bracket having a rear portion cooperatively configured and slidable in said channel, said bracket including a lower clamp having a body portion with a clamping surface at its upper end and a depending leg portion, and a top clamp having a body portion with a depending leg portion and a clamping surface at its lower end cooperating with the clamping surface of said lower clamp, said leg portions being slidable relative to each other, an adjusting screw on said lower clamp engaged with said upper clamp to effect relative movement between said clamping surfaces to clamp a shelf between said clamping surfaces below said shelf, and a shelf having an end clamped in said bracket, said bracket also having a positioning fastener seated in said lower clamp below said shelf and extending through said clamps to engage said support to secure said clamps to each other and to said support.

2. The modular shelf assembly in accordance with claim 1 wherein said vertical support is configured to provide a bracket receiving channel in opposite faces thereof.

3. The modular shelf assembly in accordance with claim 2 wherein said vertical support has four faces and panel receiving channels in the other faces thereof.

4. The modular shelf assembly in accordance with claim 1 wherein channel has a keyway at the inner end thereof which seats a locking washer cooperating with positioning fasteners.

5. The modular shelf assembly in accordance with claim 1 wherein said upper clamp has a recess which seats a locking washer cooperating with said adjusting screw.

6. The modular shelf assembly in accordance with claim 1 wherein said lower clamp has a channel in which is slidable said depending leg portion of said upper clamp.

* * * * *